United States Patent [19]

Bohli

[11] 4,104,708

[45] Aug. 1, 1978

[54] SHROUDED CHEMICAL LIGHT SOURCE

[75] Inventor: William H. Bohli, Catonsville, Md.

[73] Assignee: The United States of America as represented by the Secretary of the Navy, Washington, D.C.

[21] Appl. No.: 486,556

[22] Filed: Jul. 8, 1974

[51] Int. Cl.[2] ..... F21V 9/16

[52] U.S. Cl. ..... 362/34; 250/485; 362/319

[58] Field of Search ..... 240/2.25, 10.6 R, 10.66; 206/804; 43/17.6; 250/483, 485; 220/8; 362/34, 319

[56] References Cited

U.S. PATENT DOCUMENTS

| | | | |
|---|---|---|---|
| 575,621 | 1/1897 | Smith | 220/8 |
| 1,809,355 | 6/1931 | Powell | 220/8 |
| 1,827,396 | 10/1931 | Luckett | 220/8 |
| 3,354,828 | 11/1967 | Shefler et al. | 240/2.25 |
| 3,819,925 | 6/1974 | Richter et al. | 240/2.25 |
| 3,857,036 | 12/1974 | Novak | 250/485 |
| 3,861,072 | 1/1975 | Holcombe | 240/2.25 X |
| 3,884,560 | 5/1975 | Neylan et al. | 240/2.25 X |

OTHER PUBLICATIONS

"The Swimmer Weapons System:General Purpose Weapons and Tools" Navord OP 3703, vol. 2, Part 2, pp. 1-2, 2-3.

*Primary Examiner*—L. T. Hix
*Assistant Examiner*—Alan Mathews
*Attorney, Agent, or Firm*—R. S. Sciascia; A. L. Branning; H. B. Field

[57] ABSTRACT

A self-luminescent article which comprises an opaque tubular shroud and a chemiluminescent device which comprises a light transmitting tubular body containing a chemiluminescent material, the chemiluminescent device being in telescopic relationship with the shroud and the shroud being provided with a stop means which prevents the complete removal of the chemiluminescent device from the shroud. The shroud permits the chemiluminescent device to be concealed while in operation and prevents the premature activation thereof.

7 Claims, 1 Drawing Figure

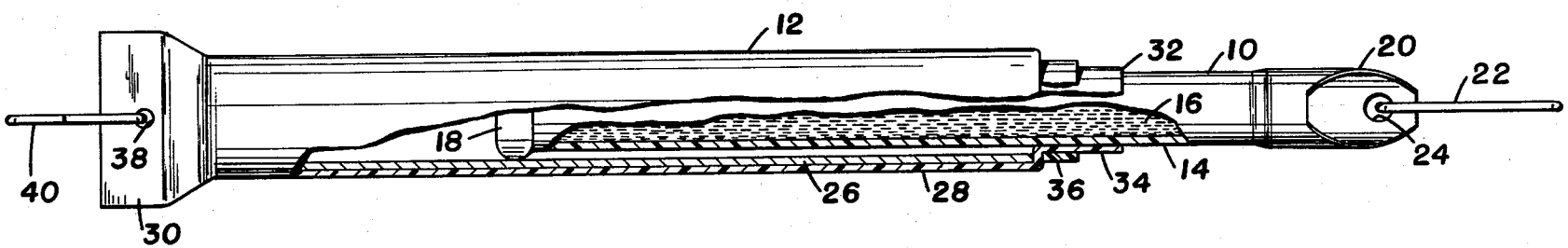
FIGURE

SHROUDED CHEMICAL LIGHT SOURCE

BACKGROUND OF THE INVENTION

This invention is related to illumination and more particularly to self-luminous articles such as a chemiluminescent light device.

Much effort has been devoted to the development of chemical light sources as evidenced by U.S. Pat. No. 3,539,794 to Rauhut et al issued Nov. 10, 1970; U.S. Pat. No. 3,576,987 to Voight et al issued May 4, 1971; and U.S. Pat. No. 3,752,406 to McDermott et al issued Aug. 14, 1973, all of these patents being incorporated herein by reference. The disclosures of these patents specify many advantages for these chemiluminescent devices. For example, any emergency requiring the use of light is a suitable use for such a chemiluminescent device. The light is a cool light which is advantageous when the heat from electric powered light sources is not safe. The chemiluminescent device is even suitable for use underwater because no electric power is required.

One major problem exists, however, with the use of such a light source. Once the chemicals in the chemiluminescent light device are mixed in order to produce light there is no convenient way to extinguish the light produced thereby. Yet, on many occasions, it may be desirable to extinguish the light before the light-producing chemical reaction is complete. For example, in many military operations, the 3 to 24 hour illumination time is too long to be desirable, and it is necessary to extinguish the light to avoid detection. One possible solution is to make smaller devices with a short lifetime. It is possible, however, that such short-lived devices would not produce adequate light or would complicate the situation by requiring a large number of chemiluminescent light devices to be carried. It may also be undesirable to extinguish the chemiluminescent light device by hiding it away from the operation or destroying it. Both of these means require the loss of the light source to the operation. However, it may become necessary to conceal the light source after activation while retaining the ability to reuse it when necessary.

A chemiluminescent light device is required to be fragile in order to permit easy activation. But the fragility renders the device subject to premature activation and permits detection of one who happens to carry the device. Thus, it is also desirable to render the chemiluminescent light device less fragile.

SUMMARY OF THE INVENTION

Therefore, it is an object of this invention to provide a concealable, activated, chemiluminescent device.

Also, it is an object of this invention to provide a chemiluminescent device which avoids premature activation.

It is a still further object of this invention to provide a chemiluminescent device which is not detectable when activated.

These and other objects of the invention, are met by providing a stiff, opaque shroud for a chemiluminescent light source.

BRIEF DESCRIPTION OF THE DRAWINGS

The sole FIGURE of the drawing shows a chemiluminescent device enclosed in an opaque shroud with a portion cut away for the purpose of facilitating description thereof.

DESCRIPTION OF THE PREFERRED EMBODIMENTS

The chemiluminescent device is encased in a opaque shroud which is rigid enough to protect the device from premature activation.

Any standard chemiluminescent device such as those disclosed in the above-referenced patents is adaptable to this invention and may use a suitable encasing means such as a shroud for protecting the device before and after activation and for concealing the device after activation. The encasing means is any suitable, substantially rigid, substantially unbreakable, and shock absorbable material. Metal tubes are suitable as are synthetic resin tubes so long as the above set forth standards are met. Even combinations of metal, synthetic resins, or metals and synthetic resins are suitable materials for forming an opaque shroud or encasing means for a chemiluminescent device.

If two or more components form the shroud, the opacity and rigidity may be supplied by a single component or any combination of components. The device is usually slideably or frictionally held in the shroud.

As shown in the FIGURE, a chemiluminescent device 10 of the type known and used in the art is slideably and frictionally encased in a mating relationship with a shroud 12. The device 10 is shown to be in its partially exposed position in order to facilitate description of the invention. The shroud 12 is substantially long enough to enclose the light-emitting portion of the device 10 should the device be activated.

The device 10 comprises, a transparent flexible hollow member 14 closed on each end which contains standard liquid chemiluminescent material 16 such as that known in the art. Hollow member 14 is the section of device 10 which provides light when the device 10 is activated. Examples of devices such as device 10 are well-known as evidenced by the above cited patents incorporated herein by reference. While the device 10 may have any suitable shape which enables it to perform the desired function, device 10 is depicted in the drawings with the hollow member 14 being cylindrical. The hollow member 14 has an enlarged or expanded shrouded end 18 and an exposed and enlarged or expanded end 20. Shrouded end 18 provides substantially no light when device 10 is activated and mates interiorly with the shroud 10 in a slideable relationship so that shrouded end 18 is received by the shroud 12. The exposed expanded end 20 is too large to permit device 10 to slide completely into shroud 12 but does permit the transparent hollow member 14 of device 10 to be completely covered by the shroud 12. Mounted on the exposed end 20 of the device 10 is a pulling means of any suitable design which facilitates sliding of device 10 out of shroud 12. For example, a ring 22 mounted on the exposed end 20 of the device 10 may be used to slide device 10 out of shroud 12. However, ring 22 is optional and may be replaced by any suitable means. Also, exposed end 20 may serve as the pulling means. As depicted, the enlarged or shrouded end 18 is the only part of the hollow member 14 in direct physical contact with the interior of the shroud 12 thereby forming a mated slideable relationship between the shroud 12 and the device 10.

The shroud 12 is required to be substantially rigid in order to protect the device 10 from premature breakage, and to be opaque in order to completely conceal the luminescent portion of the device 10 when the device is activated. It follows that the shroud 12 is of sufficient size to conceal at least the hollow member 14 which is the transparent section which provides the light from the device 10 when the device 10 is activated. In order to provide the shroud 12 with the desired opacity and rigidity, many options are open. The shroud 12 may comprise metal, synthetic resins, or combinations thereof so long as the desired rigidity and opacity of the shroud is maintained. As shown in the FIGURE, the shroud 12 is a combination of an anodized aluminum tube 26 covered with a heat shrinkable vinyl sheet 28. The tube 26 and the sheet 28 combine to provide the substantially rigid opaque shroud 12 which serves to conceal the activated device 10 when the device 10 is pushed into the shroud 12, and to protect the device 10. The shroud 12 and device 10 are in slideable and frictional relationship with one another which serves to position the device 10 relative to the shroud 12. The tube 26 has a crimped end 30 which serves as a stopping means for the shrouded end 18 of device 10. Any other stopping means is suitable so long as device 10 does not pass through the shroud 12. For example, a closure in threaded relation with the tube 26 may replace crimped end 30.

Opposite crimped end 30 of tube 26 is an open end for receiving device 10 and through which the device 10 may be pulled. The sheet 28 extends beyond the open end 32 in order to form an extension 34. Over the extention 34 and butted against the tube 26 is a stop ring 36 which is positioned by frictional contact with extension 34. Ring 36 has an interior diameter less than the interior diameter of tube 26 and cooperates with extension 34 and shroud end 18 to prevent separation of device 10 and shroud 12. It is understood that although ring 36 is frictionally fitted to extension 34, the ring may also be secured to tube 26 by other means such as glueing or the like. An aperture 38 is formed in crimped end 30 through which a carrying means is mounted. The carrying means is exemplified by S-ring 40.

In operation, the chemiluminescent part of light device 10 is completely concealed in the shroud 12. When activation is desired, the shroud 12 is held in one hand, and the ring 22 is grasped with the other hand. A pulling force is exerted which removes the device 10 from the shroud 12 at least partially or preferably to an exposed position. The ring 36, and the shrouded end 18 of the device 10 cooperate so that the device 10 and the shroud 12 do not separate. After the device 10 is at least partially exposed relative to the shroud 12, the device 10 is flexed thereby breaking a capsule (not shown) contained within the hollow member 14. The capsule contains a chemical (preferably liquid) which mixes with another chemical (preferably liquid) contained in the hollow member 14 to react and produce light. Other suitable examples of devices are disclosed in the above-referenced patents. If the light source is no longer needed before the chemical light is used up, it is possible to push the device 10 back into the shroud 12 to the enclosed position in order to conceal the light. If light is again desired before the chemical reaction is complete the device 10 is simply pulled out of the shroud 12 again. Concealing and reexposing the light may be continued for as long as the chemical reaction which produces light lasts. Exposed end 20 of device 10 contains no chemiluminescent liquid 16 so that light from an activated device 10 may be completely concealed.

Stop ring 36 and crimped end 30 combine to prevent separation of device 10 and shroud 12. It is possible to replace crimped end 30 with a removable or separable closure means, and to replace stop ring 36 with a removable or separable stopping means. Such separable closure means or removeable stopping means easily permit reuse of the shroud after expiration of device 10 by replacement with a fresh, unactivated device 10. The shroud 12 depicted in the drawing is also reusable if a suitable device having a stop ring 36 mounted thereon is provided. Use of removable or separable stopping means permit separation of the device 10 and the shroud 12. In most cases, it is not desirable to separate the shroud 12 and the device 10. But in the case where separation is desirable, removable or separable stopping means are suitable.

Another version utilizes a molded housing with a tapering outline. To obtain a frictional stop of all positions of the tapering light source it is necessary to replace the shroud stop means 36 (e.g. an aluminum collar) with a spring collar, or allow the vinyl cover to provide the frictional surface. The shroud may be modified for all sizes of light sources now being produced.

It is also possible to limit the visibility of the light to a given direction by including a fold down flap that can be positioned when required.

The aluminium ring can be replaced by a twisted wire. The aluminum housing can be deleted without affecting the operational principle. Materials can vary to accomplish the same herein disclosed design. For example, polyethylene and polypropyline are suitable, heat shrinkable resins for the shroud. The chemiluminescent device is any suitable device such as those disclosed in the above-referenced patents.

Obviously, many modifications and variations of the present invention are possible in light of the above teachings. It is therefore to be understood that within the scope of the appended claims, the invention may be practiced otherwise than as specifically described.

What is claimed and new and desired to be secured by Letter Patents of the United States is:

1. Self-luminescent article comprising an opaque tubular shroud and a chemiluminescent device which comprises a light transmitting tubular body having closed ends, said tubular body containing a chemiluminescent material;

said chemiluminescent device being in telescopic relationship with said shroud and reciprocally moveable therein, one end of said device being contained within said shroud and the other end being exposed, said end of the device contained within said shroud having a portion of larger cross-sectional area than the remainder of said device contained within said shroud, said shroud being provided with a stop means which cooperates with said enlarged end of the chemiluminescent device to prevent the complete removal of said chemiluminescent device from said shroud.

2. The article of claim 1 wherein one end of the shroud is provided with a second stop means which prevents the complete enclosure of the chemiluminescent device within the shroud.

3. The article of claim 1 wherein the exposed end of the chemiluminescent device has a portion of larger cross-sectional area than the remainder of the exposed part of said device, and said exposed end cooperates with said stop means to prevent the complete enclosure of the chemiluminescent device within the shroud.

4. The article of claim 1 wherein the outer surface of the chemiluminescent device is in frictional contact with the stop means.

5. The article of claim 1 wherein the shroud is rigid.

6. The article of claim 4 wherein the exposed end of the device is provided with a pulling means which enables the device to be substantially exposed outside of the shroud.

7. A self-luminescent article comprising a tubular shroud, which is open at one end and at least partially closed at the other end, and a chemiluminescent device which comprises a light-transmitting tubular body having closed ends, said tubular body containing a chemiluminescent material, said chemiluminescent device being in telescopic relationship with said shroud and reciprocally moveable therein, one end of said device being contained within said shroud and the other end being exposed, said end of the device contained within said shroud having a portion of larger cross-sectional area than the remainder of said device contained within said shroud, said shroud being provided with a heat-shrinkable plastic cover, a portion of said cover extending beyond said open end of said shroud, a rigid collar being concentrically disposed over said extended portion of said cover and constricting said extended portion of said cover to a cross-sectional area which is smaller than said end of said chemiluminescent device contained within said shroud, the constricted, extended portion of said cover cooperating with the enlarged end of said device contained within said shroud to prevent the complete removal of said chemiluminescent device from said shroud.

* * * * *